US005403652A

United States Patent [19]

Drougge

[11] Patent Number: 5,403,652

[45] Date of Patent: Apr. 4, 1995

[54] TOOL OF CEMENTED CARBIDE FOR CUTTING, PUNCHING OR NIBBLING

[75] Inventor: Lars Drougge, Djurhamn, Sweden

[73] Assignee: Sandvik AB, Sandviken, Sweden

[21] Appl. No.: 57,559

[22] Filed: May 6, 1993

Related U.S. Application Data

[62] Division of Ser. No. 803,413, Dec. 6, 1991, Pat. No. 5,235,879.

[30] Foreign Application Priority Data

Dec. 10, 1990 [SE] Sweden ..... 9004124

[51] Int. Cl.[6] ..... B32B 15/04

[52] U.S. Cl. ..... 428/216; 51/307; 51/309; 428/469; 428/698

[58] Field of Search ..... 428/698, 469, 216; 51/307, 309

[56] References Cited

U.S. PATENT DOCUMENTS

| | | | |
|---|---|---|---|
| 3,909,895 | 10/1975 | Abrahamson et al. | 29/95 A |
| 4,339,272 | 7/1982 | Grover et al. | 75/240 |
| 4,359,335 | 11/1982 | Garner | 75/208 A |
| 4,610,931 | 9/9186 | Nemeth et al. | 75/240 |
| 4,642,003 | 2/1987 | Yoshimura | 408/144 |
| 4,705,124 | 11/1987 | Abrahamson et al. | 428/698 |
| 4,731,296 | 3/1988 | Kikuchi et al. | 428/698 |
| 4,743,515 | 5/1988 | Fischer et al. | 428/698 |
| 4,843,039 | 6/1989 | Akesson et al. | 501/93 |

FOREIGN PATENT DOCUMENTS

| | | |
|---|---|---|
| 1282137 | 12/1961 | France . |
| 59-219122 | 12/1984 | Japan . |
| 60-25605 | 2/1985 | Japan . |
| 2114041 | 8/1983 | United Kingdom . |
| 2179678 | 3/1987 | United Kingdom . |

OTHER PUBLICATIONS

A. T. Santhanam et al, "Innovations in Coated Carbide Cutting Tools", MPR Dec. 1987, pp. 841–845.

*Primary Examiner*—A. A. Turner

*Attorney, Agent, or Firm*—Burns, Doane, Swecker & Mathis

[57] ABSTRACT

There is provided a cemented carbide tool for punching, cutting or nibbling containing WC and a binder comprising at least one of the metals Co, Ni and Fe. The tool comprises a core of eta-phase-containing cemented carbide surrounded by an eta-phase-free surface zone with the working surface of the tool comprising exposed eta-phase-containing cemented carbide.

12 Claims, 1 Drawing Sheet

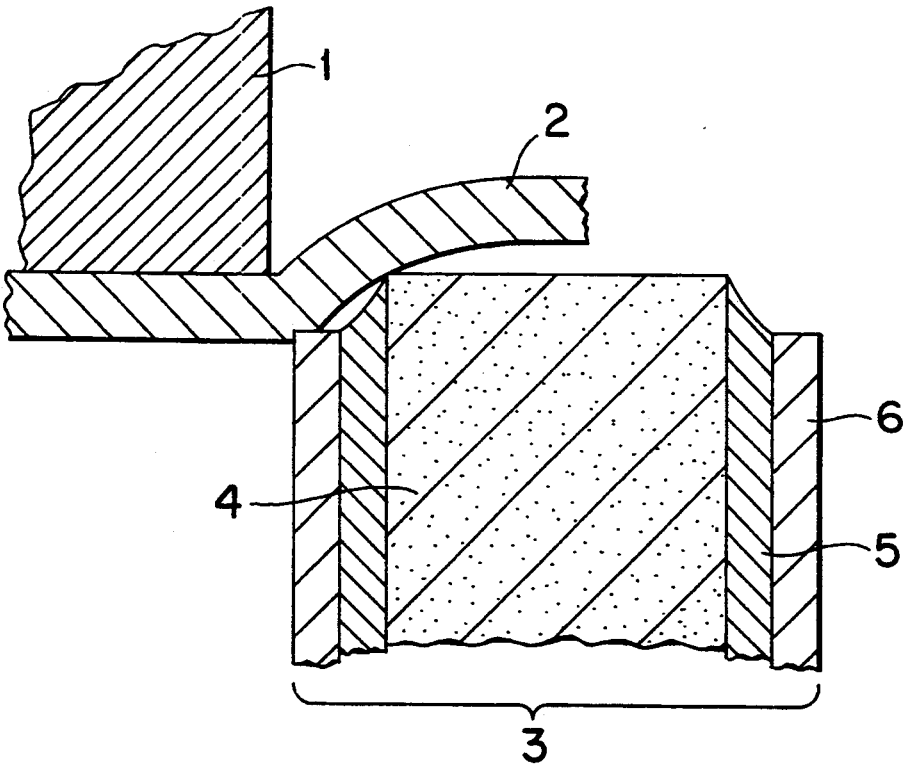
1
2
6
4
5
3

TOOL OF CEMENTED CARBIDE FOR CUTTING, PUNCHING OR NIBBLING

This application is a divisional of application Ser. No. 07/803,413, filed Dec. 6, 1991, now U.S. Pat. No. 5,235,879.

BACKGROUND OF THE INVENTION

The present invention relates to a cemented carbide tool for cutting, punching or nibbling which, by means of a special way of manufacturing, has surprisingly better properties in comparison to those of conventional tools.

The manufacture of sheet metal parts is normally done by cutting and punching. By both of these methods the parting of the material occurs between two edges working against each other. The yield point of the material is exceeded at sufficiently a high cutting or punching force.

Nibbling is used for the purpose of cutting contours in normally 3–10 mm thick sheet metal. Cylindrical punches of steel or cemented carbide are most frequently used in a nibbling machine. They perforate the sheet metal by a movement perpendicular to the metal through a die used as a dolly. When nibbling and punching holes, different widths of the slot in the die are used, which are adjusted to suit the composition and sheet thickness of the material. When a so-called "wide slot" is being used, the cutting, when nibbling is taking place, depends on both shear and tensile forces. Using a narrow slot, the cutting of the sheet takes place due to pure shear forces.

The normal wear pattern of a steel nibbling punch is that material by abrasion is worn off and moved up along the punch. Because of the wear pattern, the punch turns conical which in turn finally causes an increased friction force that changes the cutting quality to an unacceptable level. When using cemented carbide punches, this wear process is considerably slower, but with the same result as obtained by the used of steel punches. Due to the brittleness of the cemented carbide the risk of fracture is great. As a result, cemented carbide punches are used only exceptionally.

In U.S. Pat. No. 4,743,515, there is disclosed a cemented carbide preferably for use in rock drilling but also for wear parts and other parts exposed to wear. It is characterized by a core containing eta-phase surrounded by cemented carbide free from eta-phase.

OBJECTS OF THE INVENTION

The object of the present invention is to avoid or alleviate the prior art.

Another object of the invention is to provide a cemented carbide tool for use in cutting, punching or nibbling operations with increased toughness, a method for making that tool and a method for using the tool.

SUMMARY OF THE INVENTION

In one aspect of the invention there is provided a cemented carbide tool for cutting, punching or nibbling containing WC ($\alpha$-phase) with a binder ($\beta$-phase) based on at least one of the metals Co, Ni or Fe and comprising a cemented carbide containing eta-phase surrounded by a surface zone free from eta-phase wherein the working surface of the tool comprises exposed eta-phase.

In another aspect of the invention there is provided a method of manufacturing a cemented carbide tool for cutting, punching or nibbling by powder metallurgical methods comprising sintering a blank of a substoichiometric cemented carbide to an eta-phase-containing cemented carbide blank that thereafter is at least partially carburized to form an eta-phase-containing core surrounded by an eta-phase-free surface zone with the eta-phase in the working surface being exposed.

In a third aspect of the invention there is provided the use of a cemented carbide tool for cutting, punching or nibbling containing WC ($\alpha$-phase) with a binder ($\beta$-phase) based on at least one of the metals Co, Ni or Fe, the improvement comprising using a cemented carbide having an eta-phase-containing cemented carbide core surrounded by an eta-phase-free surface zone, the working surface of the tool comprising exposed eta-phase.

BRIEF DESCRIPTION OF THE FIGURE

The Figure presents a die and a punching tool in accordance with the invention where:

1=die
2=metal sheet
3=punch
4=cemented carbide containing eta-phase
5=cobalt enriched surface zone
6=cobalt depleted surface zone

DETAILED DESCRIPTION OF THE PREFERRED EMBODIMENTS OF THE INVENTION

Punches for nibbling have been produced in accordance with U.S. Pat. No. 4,743,515. When testing these punches, disastrous fractures appear after an unacceptably short time. Fractures mostly take place along the working edge. After grinding at right angles to the longitudinal axis of the punch to remove the outer eta-phase-free zone of the end portion of the punch, the cutting performance surprisingly increased in a most dramatic way. The wear mechanism along the cutting edge is changed to a loss of material in the shape of very tiny and thin "flakes". Owing to this wear pattern, the sharpness of the edge is retained in spite of the fact that the edge slowly moves up along the punch. See the Figure. There is no formation of a conical shape. The desired cutting gap is not altered but kept essentially constant. The central portion of the punch is on the whole not changed at all due to the wear. When the cutting edge has moved upwards the punch to a distance corresponding to that of the wear-formed cone in the case of the steel punch, this type of cemented carbide punch must be reground. This happens after a number of punching cycles that by far exceeds that obtained with steel punches. The limiting factor to the tool life has turned out to be the protruding flange at the top part of the punch that serves as a holding gadget, which probably depends on an unfavorable distribution of stresses. This problem is suitably remedied by special measures resulting in more favorable stress distribution.

According to the invention, a cemented carbide tool now is provided for cutting, punching or nibbling. It is made of cemented carbide mainly consisting of WC+ a binder based on Co, Ni or Fe. The amount of binder should be 5–20%, preferably 6–16%, by weight. The grain size of the WC used should be less than 5 $\mu$m, preferably 0.4–3 $\mu$m. The cemented carbide may contain less than 3%, preferably less than 1%, by weight of other carbides such as TiC, TaC, NbC, VC, $Mo_2C$ and HfC.

The core of the cemented carbide is an eta-phase-containing cemented carbide surrounded by cemented carbide free from eta-phase with the exception for the working surface of the punch where the eta-phase is exposed according to the present invention. The eta-phase shall have a fine grain size of 0.4–10 μm, preferably 1–5 μm, and shall be evenly distributed within the matrix of the normal structure of WC and binder in the core. In the transition area towards the eta-phase-free cemented carbide, the eta-phase may have a slightly coarser grain size than otherwise in the core. The content of eta-phase in the core is 2–60%, preferably 10–35%, by volume.

The thickness of the eta-phase-free cemented carbide shall be 0.3–10 mm, preferably 0.5–8 mm. For other cross-sections than circular, the corners should be shaped in order to shape radii of the corners to about the same radii dimensions as the thickness of the eta-phase-free cemented carbide. In the inner part of the eta-phase-free surface zone situated close to the core, the amount of binder is greater than the nominal amount of binder in the cemented carbide body. The amount of binder in the surface zone increases towards the core up to at least 1.2, preferably 1.4–2.5, times the nominal content of the binder-phase in the cemented carbide body. In the outermost part of the surface zone, the content of the binder is lower, 0.1–9, preferably 0.2–0.8, times the nominal binder content. The width of the outermost binder depleted zone is 20–80%, preferably 30–70%, of the thickness of the zone free from eta-phase.

The tool according to the invention is manufactured in accordance with powder metallurgical methods such as milling, pressing and sintering. By starting with a powder that is substoichiometric with regard to the carbon content, an eta-phase-containing cemented carbide is obtained after sintering. The sintered product is heat treated in a carburizing atmosphere after sintering which gives the desired structure to the cemented carbide. This technique is described in U.S. Pat. No. 4,743,515. The working surface of the tool of the invention containing an exposed eta-phase-containing portion can be obtained by grinding the carburized material to remove the carburized eta-phase-free end portion of the cemented carbide and expose the eta-phase-containing core and eta-phase-free surface zones of the surrounding surfaces. Alternatively, the working surface can be protected during the carburizing step of the process, for example, by packing the material tightly together end to end or covering it with material that protects the ends against reaction. Preferably also, the opposite end surface of the tool is protected in a corresponding way to increase its impact resistance.

An explanation to the good properties of the tool of the present invention may be the reduction of the axial prestresses which are introduced by the carburizing treatment. This would cause the special wear pattern with wear of material in the shape of very thin "flakes". The invention refers to the use of the above-described tool for cutting, punching or nibbling purpose.

The invention is additionally illustrated in connection with the following Examples which are to be considered as illustrative of the present invention. It should be understood, however, that the invention is not limited to the specific details of the Examples.

EXAMPLE 1

From a powder containing 2–3 μm WC and 11% Co with a substoichiometric carbon content (5.1% instead of 5.4%), blanks were pressed which, disregarding the dimensions of the holder, were shaped to a length of 84 mm and a diameter of 12.2 mm. The blanks were presintered in nitrogen for 1 hour at 900° C. and standard sintered at 1430° C. They were then loosely packed in a fine aluminum oxide powder in graphite boxes and thermally treated in a carburizing atmosphere for two hours at 1370° C. in a pusher furnace. A very thin zone of only $\alpha+\beta$ structure was formed in the surface of the blanks due to the carbon diffusion into the blanks and transformation of the eta-phase to α- and β-phases. After two hours treatment, enough carbon had diffused into and transformed all eta-phase of the surface zone. The blanks manufactured in this way had after the treatment a 2 mm eta-phase-free surface zone and a core with 5 mm diameter containing finely dispersed eta-phase. The part of the surface zone closest to the eta-phase-containing core was enriched with cobalt. Thus, the outermost part of the surface zone was depleted of cobalt and consequently also harder. The working end parts of the punch blanks were cut 5 mm and ground to expose the eta-phase-containing core surrounded by the eta-phase-free zone of the side surfaces of the blank.

EXAMPLE 2

A punch made according to Example 1 was tested on the following conditions:

Machine: Pullman Pullmatic
Stroke: 30 mm turning point 1 mm below the sheet
Motor speed: 200 r/min
Slot width: 0.30 mm for 2 mm sheet metal 0.35 mm for 3 mm sheet metal
Material: Stainless steel SIS 2333

The cutting edge of the punch was examined at even intervals. After some 34,153 strokes, only 12 very small and thin "flakes" had come off while the used sheet was replaced by a 3 mm thick sheet of the same material. After some 48,689 strokes, the punch was examined again. Now one could see that 3 more small "flakes" had come off. The test carried on until the total amount of strokes was 64,000. The punch was then ground flat, the reduction in tool length was measured to be 0.25 mm.

The test was then repeated with a conventional steel punch (SIS 2260) under the same conditions as above. After 7,231 strokes, the punch was conical to the extent that it had to be reground. In this case, the reduction in length was 5 mm. Due to the conical shape, the quality of the hole successively turns worse. Even the cutting force increases dramatically which may cause a stand still of the machine.

In a third test, a punch manufactured of a cemented carbide of standard grade 11% Co and with a grain size of around 2–3 μm was used. Also this time the same type of material and conditions were applied. The result from this test was that the edge of the punch broke down after 15 strokes.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. Cemented carbide tool for cutting, punching or nibbling containing WC ($\alpha$-phase) with a binder ($\beta$-phase) based on at least one of the metals Co, Ni or Fe and comprising a cemented carbide containing eta-phase surrounded by a surface zone free from eta-phase wherein the working surface of the tool comprises exposed eta-phase.

2. The cemented carbide tool of claim 1 wherein the working surface of the tool also comprises an eta-phase-free surface zone surrounding the exposed eta-phase.

3. The cemented carbide tool of claim 2 wherein the width of the eta-phase-free zone is 0.3–10 mm.

4. The cemented carbide tool of claim 3 wherein the width of the eta-phase-free zone is 0.5–8 min.

5. The cemented carbide tool of claim 1 wherein the grain size of the eta-phase is 0.5–10 $\mu$m and the amount of eta-phase in the core is 2–60 volume %.

6. The process of claim 5 wherein the grain size of the eta-phase is 1–5 $\mu$m and the amount of eta-phase in the core is 10–35 volume %.

7. The cemented carbide tool of claim 1 wherein the amount of binder in the outermost portion of the surface zone is 0.1–0.9 times the nominal content of binder.

8. The cemented carbide tool of claim 7 wherein the amount of binder in the outermost portion of the surface zone is 0.2–0.7 times the nominal content of binder.

9. The cemented carbide tool of claim 7 wherein the width of the said outermost portion of the surface zone is 0.2–0.8 times the width of the eta-phase-free zone.

10. The cemented carbide tool of claim 9 wherein the width of the outermost portion of the surface zone is 0.3–0.7 times the width of the eta-phase-free zone.

11. The cemented carbide tool of claim 1 wherein the inner part of the surface zone next to the eta-phase-containing core has a content of binder that is greater than the nominal content of binder and the binder content increases towards the core to at least 1.2 times of the nominal content of binder in the cemented carbide body.

12. The cemented carbide tool of claim 11 wherein the inner part of the surface zone next to the eta-phase-containing core has a content of binder that is greater than the nominal content of binder and the binder content increases towards the core to at least 1.4–2.5 times of the nominal content of binder in the cemented carbide body.

* * * * *